United States Patent [19]

Rogge et al.

[11] Patent Number: 5,009,157

[45] Date of Patent: Apr. 23, 1991

[54] ROTARY PRESS COMPRISING AN ENDLESS BLOCK BELT

[75] Inventors: Dieter Rogge; Wilfried Wallmann, both of Lengerich, Fed. Rep. of Germany

[73] Assignee: Windmoller & Holscher, Lengerich, Fed. Rep. of Germany

[21] Appl. No.: 340,204

[22] Filed: Apr. 19, 1989

[30] Foreign Application Priority Data

Apr. 19, 1988 [DE] Fed. Rep. of Germany ..... 3813112

[51] Int. Cl.[5] ..... B41F 5/18; B41F 13/00

[52] U.S. Cl. ..... 101/178; 101/DIG. 48

[58] Field of Search ..... 101/219, 212, 171, DIG. 48, 101/178, 174, 177, 179–182, 216, 136–140, 141–145, DIG. 33, 247

[56] References Cited

U.S. PATENT DOCUMENTS 2,788,738 4/1957 Wood ..... 101/171

FOREIGN PATENT DOCUMENTS 1144420 4/1983 Canada .

*Primary Examiner*—J. Reed Fisher

*Attorney, Agent, or Firm*—Fleit, Jacobson, Cohn, Price, Holman & Stern

[57] ABSTRACT

A rotary press comprises one or more impression cylinders (1) and a plurality of printing units, each of which comprises an inking unit (I) and an endless block belt (4). The block belt (4) is trained around a plurality of cylinders (5, 6, 7, 8), one of which (7) is movable into engagement with an associated impression cylinder (1). In the rotary press, the block belt of each printing unit is trained around four cylinders, which are disposed at the corners of a square or parallelogram. Two diametrically opposite ones (7, 8) of the cylinders are movable into engagement with the inking unit (I) and a picture-carrying web or an associated impression cylinder, and the two other diametrically opposite cylinders (5, 6) are tensioning cylinders, which are movably mounted in tracks (31) and, by a drive device (39), are movable toward and away from each other.

11 Claims, 5 Drawing Sheets

ROTARY PRESS COMPRISING AN ENDLESS BLOCK BELT

BACKGROUND OF THE INVENTION

1. Field of the Invention

This invention relates to a rotary press comprising one or more impression cylinders and a plurality of printing units, each of which comprises an inking unit and an endless block belt, which is trained around a plurality of cylinders, one of which is movable into engagement with an associated impression cylinder.

2. Description of the Prior Art

In a rotary press of this kind, which is known from German Patent Specification 448,987, the endless block belt is trained around a main cylinder, which is movable into engagement with an impression cylinder. The belt is also trained around a guide cylinder, which is adjustable so that the format can be changed by the use of longer or shorter block belts.

In a rotary press comprising a plurality of printing units, the distance from the inking cylinder to the impression cylinder, which distance is measured on the block belt, should always be the same so that an unclean print caused by different drying of the several inks used will be avoided.

SUMMARY OF THE INVENTION

For this reason it is an object of the invention to provide a rotary press of the kind described above and in which the distances between each inking cylinder and the associated impression cylinder, which distances are measured on the block belts, will always be the same.

This object is accomplished in accordance with the invention in that the block belt of each printing unit is trained around four cylinders, which, in a side elevation view, are disposed at the corners of a square or parallelogram. Two diametrically opposite ones of the cylinders are movable into engagement with the inking unit and a picture-carrying web or with an associated impression cylinder. The two other diametrically opposite cylinders are tensioning cylinders, which are movably mounted in tracks and, by drive means, are movable toward each other and away from each other. In the rotary press in accordance with the invention it is ensured that the length of the block belt portion extending between the cylinder that engages the inking cylinder and the cylinder that engages the impression cylinder will always be the same so that all inks applied will be dried to the same degree.

In the press in accordance with the invention, the printing cylinders and the tensioning cylinders around which the block belts are trained may be relatively small in diameter.

The center lines of the bearings of the cylinders suitably define in side elevation a parallelogram having sides which are equal or different in length.

In accordance with a further feature of the invention, the cylinders are rotatably mounted in laterally disposed mounting plates, which are rigidly interconnected and are non-rotatably connected to and laterally displaceable relative to the frame or carriage which carries the printing unit. For a sample adjustment of the lateral register, means may be provided for laterally adjusting the mounting plates.

In accordance with a further feature of the invention a gear is non-rotatably connected to and axially displaceably mounted on a stub shaft of one of the cylinders and meshes with helical teeth of a central gear for driving the impression cylinder or cylinders. A bushing is non-rotatably connected to and axially displaceably mounted on a pin, which is fixed to the machine frame. The bushing is connected to a finger or to a disk, which extends into an annular groove formed in the hub of the gear, and adjusting means are provided for axially displacing the bushing. The longitudinal register can be adjusted by adjusting means which are used to axially adjust the bushing because a forward or rearward displacement will be imparted to the cylinder when the gear for driving the cylinder is displaced on the stub shaft.

In a desirable arrangement, a format gear is rotatably mounted on and axially fixed to the bushing and meshes with the central gear and with the gear for driving the inking cylinder. The hub of the format gear carries the disk which extends into the annular groove of the hub of the cylinder-driving gear.

DETAILED DESCRIPTION OF THE PREFERRED EMBODIMENTS

Illustrative embodiments of the invention will now be described more in detail with reference to the drawings.

Figure 1:
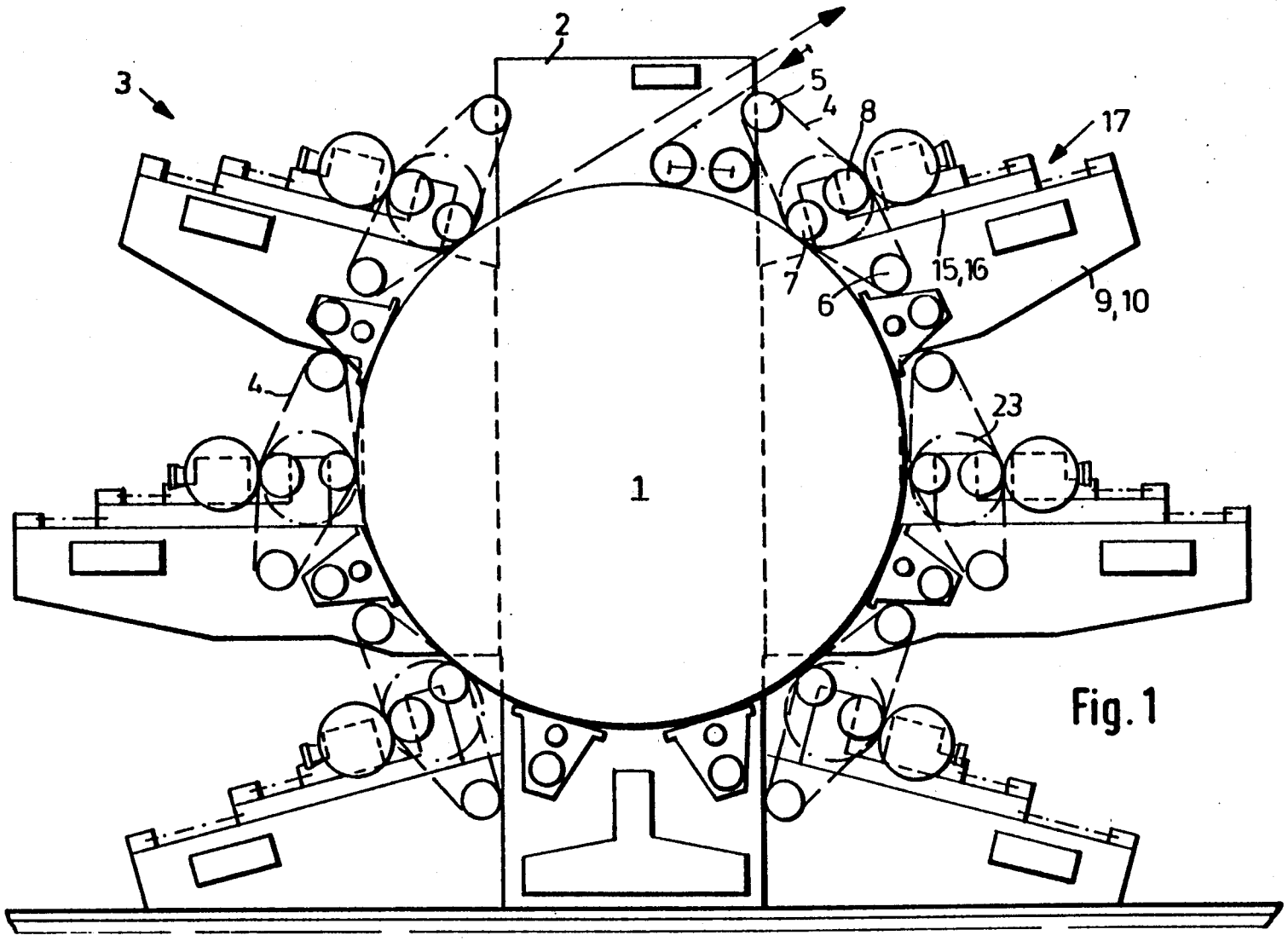
FIG. 1 is a diagrammatic side elevation view showing a printing press having a central impression cylinder and a plurality of printing units, which are distributed around the periphery of the impression cylinder.

FIG. 1 shows a printing press comprising an impression cylinder 1, which is rotatably mounted in a machine frame 2, and six printing units 3 associated with the impression cylinder.

In this embodiment, the impression cylinder 1 cooperates with all six printing units 3.

Figure 2:
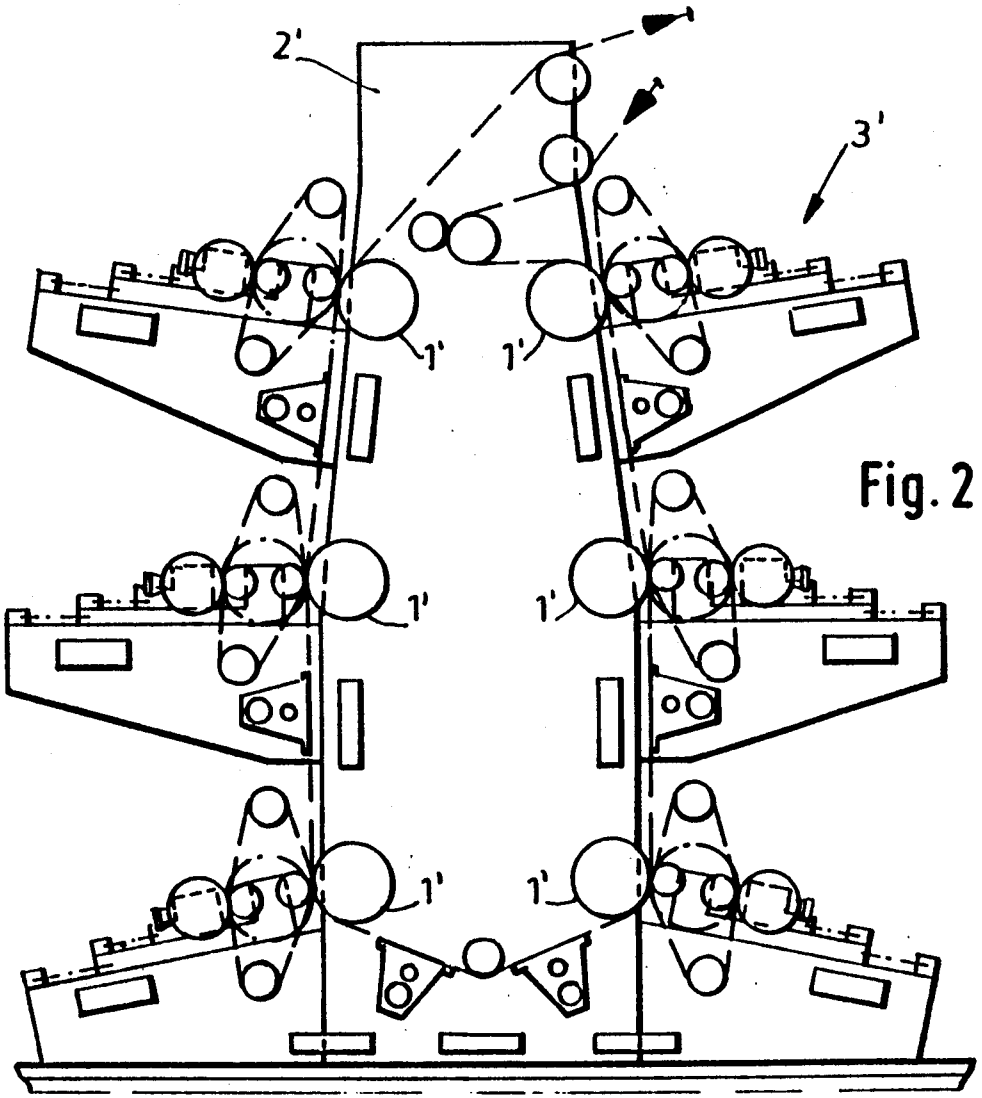
FIG. 2 is a diagrammatic side elevation view showing impression cylinders which are equal in number to the inking units.

FIG. 2 shows a machine frame 2', which carries six printing units 3', each of which has a separate impression cylinder 1' associated with it.

In each printing unit 3 or 3', the images to be printed are provided on a block belt 4, which is trained around four cylinders, namely, an upper tensioning cylinder 5, a lower tensioning cylinder 6, and two printing cylinders 7 and 8. The images to be printed may be transferred, for example, to material, such as paper or cloth, which is carried by impression cylinder 1. Both printing units 3 and 3' include a known inking unit, generally designated I, and include an inking cylinder IC to which ink is supplied in a known manner. Ink is thus transferred from inking cylinder IC to block belt 4 and from the block belt to the material carried by cylinder 1.

Figure 4:
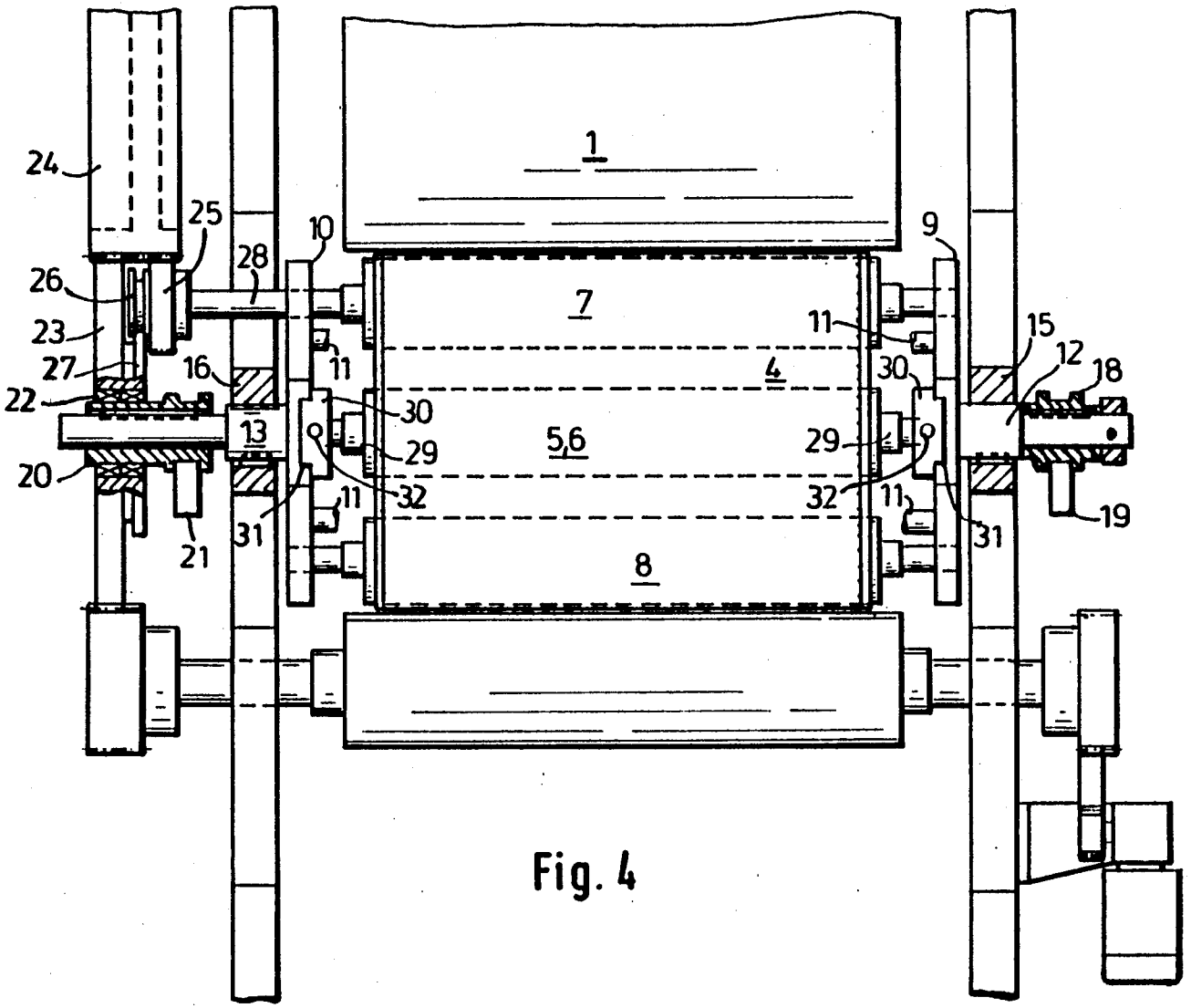
FIG. 4 is a cross-sectional view taken on line IV—IV in FIG. 3 and showing the printing unit.

As is particularly apparent from FIG. 4, all of the cylinders 5 to 8 are rotatably mounted in the printing press by axles which extend between two spaced apart, parallel side plates 9 and 10, which are rigidly interconnected by four round cross-bars 11. By means of pins 12 and 13 connected to plates 9 and 10, respectively, the two plates 9 and 10 are non-rotatably but laterally displaceably mounted in side walls 15, 16 of the format cylinder carriage 17. A bushing 18 is fixedly mounted on the pin 12 at its outer end, which protrudes from the wall 15 of the format cylinder carriage 17. A motor-operated mechanism, the motor of which is not shown, serves to adjust the lateral register and comprises an adjusting member 19 that extends into a groove formed about the circumference of the bushing 18. The pin 13 comprises an end portion 14, which protrudes from the left-hand wall 16 of the format cylinder carriage 17. A bushing 20 is non-rotatably connected to but axially displaceably mounted on the protruding end portion of the pin 13. The bushing 20 is axially adjustable relative to end portion 14 by an adjusting member 21 of a motor-operated mechanism, not shown, for adjusting the longitudinal register. The format gear 23 is mounted for rotation on the bushing 20 by means of a bearing 22 and meshes with the central gear 24, which is fixed to the impression cylinder 1 and has a diameter that corresponds to the diameter of the impression cylinder 1. The central gear 24 has helical teeth. The central gear 24 meshes also with another gear, i.e., stub shaft gear 25, which carries an extension 26 formed with an annular groove about its circumference. The annular groove receives a disk 27, which is secured to or integrally formed with the format gear 23. The adjusting member 21 serves to adjust the longitudinal register in that it axially adjusts, via the bushing 20 and the format gear 23, the gear 25, which is non-rotatably connected to and axially displaceably mounted on the stub shaft 28 of the printing cylinder 7. Upon an axial displacement of the gear 25, the latter will impart a rotation to the printing cylinder because the gear 25 meshes with the helical teeth of the central gear 24.

Dots 70, shown in FIG. 4 on the block belt 4 near its side edges, indicate teeth provided on the rear side of the belt. Such teeth may be used to cooperate with corresponding recesses in the cylinders 5–8 for positive engagement between the belt and cylinders.

Figure 3:
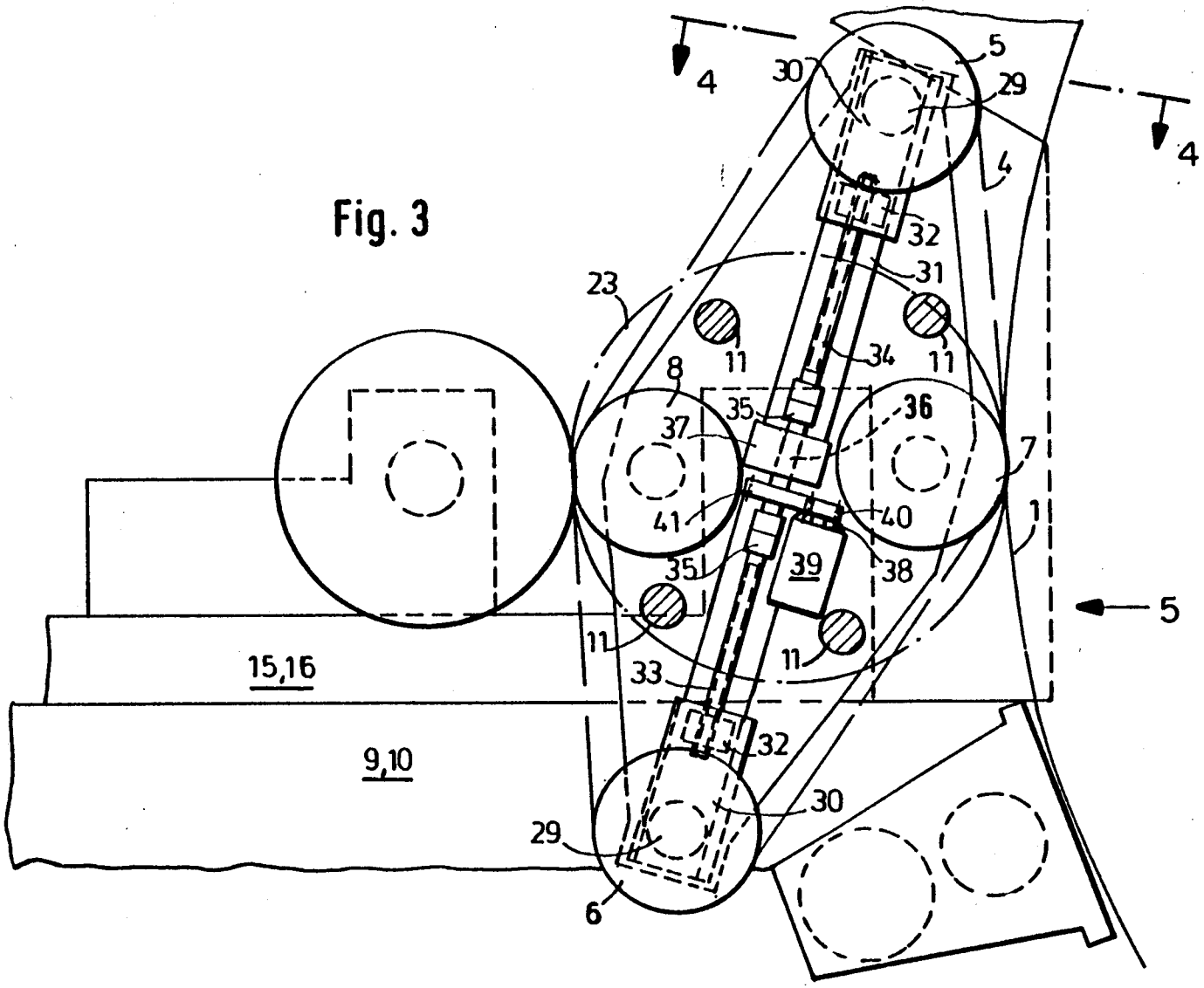
FIG. 3 is an enlarged side elevation view showing one of the belt-comprising printing units of the presses shown in FIGS. 1 and 2.
Figure 5:
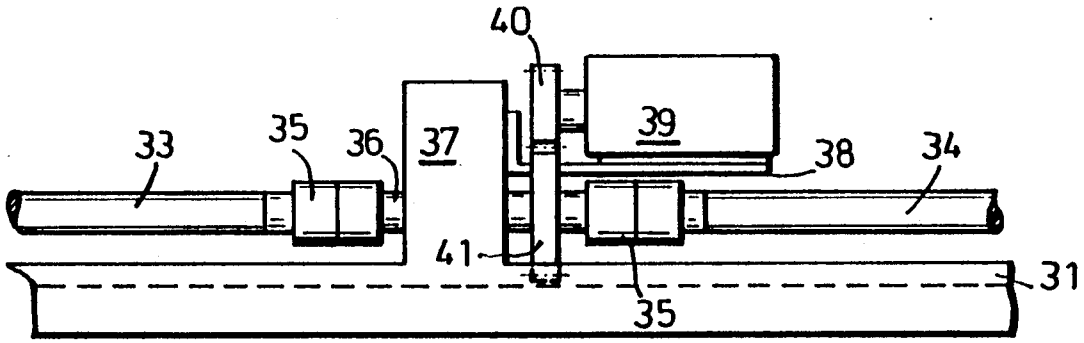
FIG. 5 is an elevation view showing the printing unit viewed in the direction of the arrow V in FIG. 3 and illustrating the arrangement of the adjusting screws associated with the two tensioning cylinders.

To permit an adjustment of the two tensioning cylinders 5 and 6 relative to each other, their stub shafts 29 are rotatably mounted in slides 30, which are guided in apertures 31 of the plates 9 and 10. Each of the two mutually opposite slides 30 mounted in apertures 31 of the respective plates 9 and 10 carries an adjusting nut 32 in engagement with screws 33 and 34, respectively (see FIG. 3), which have mutually oppositely handed screw threads. The adjacent ends of the screws 33 and 34 are coupled by sleeves 35 to a shaft 36. Shaft 36 is rotatably mounted in a bearing bracket 37, which is integrally formed with or otherwise rigidly connected, e.g., by welding, to the plates 9 and 10. An angle member 38 is connected by screws to the bearing bracket 37 and carries a motor 39, which on its output shaft carries a pinion 40 meshing with a gear 41, which is secured to the shaft 36 (FIG. 5). By operation of the motor 39, the tensioning cylinders 5 and 6 can be displaced relative to each other, i.e., either toward or away from each other, to the same extent. This is necessary to tension the block belt and to permit the use of block belts differing in length.

The invention should not be considered to be limited to the specific embodiments described; rather, the scope of the invention is defined by the claims which follow.

We claim:

1. A rotary press comprising:

at least one impression cylinder; and a plurality of printing units around said impression cylinder, each printing unit comprising:

an inking unit, four printing unit cylinders disposed relative to each other substantially at corners of a parallelogram, said four cylinders being comprised of two diametrically opposite printing cylinders and two diametrically opposite tensioning cylinders, an endless block belt extending around and in engagement with said four cylinders, a first one of said printing cylinders being adjacent said at least one impression cylinder and the other of said printing cylinders being adjacent said inking unit, track means, means for mounting said tensioning cylinders in said track means for movement toward and away from each other; and means for mounting each printing unit so that said first printing cylinder engages said block belt against said at least one impression cylinder and said other printing cylinder engages said block belt with said inking unit.

2. A rotary press as claimed in claim 1 and further comprising:

bearing means for rotatably mounting said four printing unit cylinders on each printing unit and having center lines relatively disposed with respect to each other to define in side elevation a parallelogram having sides of substantially equal length.

3. A rotary press as claimed in claim 1 and further comprising:

bearing means for rotatably mounting said four printing unit cylinders on each printing unit and having center lines relatively disposed with respect to each other to define in side elevation a parallelogram having sides of different lengths.

4. A rotary press as claimed in claim 1 and further comprising:

frame means; and printing unit mounting plates at opposite ends of said four cylinders non-rotatably mounted in and laterally displaceable relative to said frame means;

said four cylinders being rotatably mounted in said mounting plates.

5. A rotary press as claimed in claim 3 and further comprising:

frame means; and printing unit mounting plates at opposite ends of said four cylinders non-rotatably mounted in and laterally displaceable relative to said frame means;

said four cylinders being rotatably mounted in said mounting plates.

6. A rotary press as claimed in claim 4 and further comprising:

means for laterally displacing said mounting plates with respect to said frame means and each other for adjusting a lateral register of said printing unit.

7. A rotary press as claimed in claim 5 and further comprising:

means for laterally displacing said mounting plates with respect to said frame means and each other for adjusting a lateral register of said printing unit.

8. A rotary press as claimed in claim 1 and further comprising:

a central gear operatively connected to said at least one impression cylinder for driving said at least one impression cylinder;

helical teeth on said central gear;

a stub shaft on one of said four cylinders;

a stub shaft gear non-rotatably mounted on said stub shaft and having gear teeth meshing with said helical teeth on said central gear;

a hub on said stub shaft gear;

an annular groove in said hub;

a machine frame;

a pin member rigidly mounted on said machine frame;

a bushing non-rotatably and axially displaceably mounted on said pin member;

a connecting element mounted on said bushing and extending into said annular groove so that axial displacement of said bushing displaces said stub shaft axially; and adjusting means for axially displacing said bushing.

9. A rotary press as claimed in claim 3 and further comprising:

a central gear operatively connected to said at least one impression cylinder for driving said at least one impression cylinder;

helical teeth on said central gear;

a stub shaft on one of said four cylinders;

a stub shaft gear non-rotatably mounted on said stub shaft and having gear teeth meshing with said helical teeth on said central gear;

a hub on said stub shaft gear;

an annular groove in said hub;

a machine frame;

a pin member rigidly mounted on said machine frame;

a bushing non-rotatably and axially displaceably mounted on said pin member;

a connecting element mounted on said bushing and extending into said annular groove so that axial displacement of said bushing displaces said stub shaft axially; and adjusting means for axially displacing said bushing.

10. A rotary press as claimed in claim 8 and further comprising:

a format gear rotatably mounted on and axially fixed with respect to said bushing, and meshing with said helical gear of said central gear;

a hub on said format gear;

said connecting element comprising a disk member integral with said format gear hub;

said inking unit being an inking roller; and an inking roller gear means for driving said inking roller and meshing with said format gear.

11. A rotary press as claimed in claim 9 and further comprising:

a format gear rotatably mounted on and axially fixed with respect to said bushing, and meshing with said helical gear of said central gear;

a hub on said format gear;

said connecting element comprising a disk member integral with said format gear hub;

said inking unit being an inking roller; and an inking roller gear means for driving said inking roller and meshing with said format gear.

* * * * *